US005220807A

United States Patent [19]

Bourne et al.

[11] Patent Number: 5,220,807

[45] Date of Patent: Jun. 22, 1993

[54] COMBINED REFRIGERATOR WATER HEATER

[75] Inventors: Richard C. Bourne; David A. Springer; Marc A. Hoeschele, all of Davis, Calif.

[73] Assignee: Davis Energy Group, Inc., Davis, Calif.

[21] Appl. No.: 750,299

[22] Filed: Aug. 27, 1991

[51] Int. Cl.[5] ..... F25B 27/00

[52] U.S. Cl. ..... 62/238.6; 165/58; 219/441; 219/492; 307/39

[58] Field of Search ..... 62/238.6; 307/39; 219/441, 492; 165/58

[56] References Cited

U.S. PATENT DOCUMENTS

| | | | |
|---|---|---|---|
| 3,888,303 | 6/1975 | Skala | 165/2 |
| 3,935,899 | 2/1976 | Jolly | 165/29 |
| 4,024,728 | 5/1977 | Gustafsson | 62/79 |
| 4,098,092 | 7/1978 | Singh | 62/238 |
| 4,188,794 | 2/1980 | Skala | 62/82 |
| 4,299,098 | 11/1981 | Derosier | 62/160 |
| 4,373,345 | 2/1983 | Tyree, Jr. et al. | 62/79 |
| 4,399,664 | 8/1983 | Derosier | 62/328.7 |
| 4,448,037 | 5/1984 | Hama et al. | 62/188 |
| 4,511,790 | 4/1985 | Kozak | 307/39 |
| 4,514,990 | 5/1985 | Sulkowski | 62/238.7 |
| 4,528,822 | 7/1985 | Glamm | 62/238.7 |
| 4,646,537 | 3/1987 | Crawford | 62/238.7 |
| 4,821,530 | 4/1989 | Ledbetter | 62/332 |
| 4,856,578 | 8/1989 | McCahill | 165/29 |
| 5,103,078 | 4/1992 | Boykin et al. | 219/492 |

FOREIGN PATENT DOCUMENTS

| | | | |
|---|---|---|---|
| 2530994 | 1/1977 | Fed. Rep. of Germany | 62/238.6 |

*Primary Examiner*—A. Michael Chambers
*Attorney, Agent, or Firm*—Oliff & Berridge

[57] ABSTRACT

A combined refrigerator-water heating system providing one or more insulated food storage compartments, includes an insulated water storage compartment, a refrigeration system including a compressor, an evaporation heat exchanger configured to cool the food storage compartment(s), a condenser configured to heat the water storage compartment, a flow restriction/expansion device, piping connecting the compressor, condenser, expansion device and evaporation in a series flow loop, a resistance electric heating element configured to heat the water storage compartment, and a control means to activate the compressor in response to cooling demand from the food storage compartment, and to activate the electric heating element in response to either heating demand from the water storage compartment or a time-of-day signal to bias resistance electric water heating operation toward times of off-peak electric use.

21 Claims, 4 Drawing Sheets

COMBINED REFRIGERATOR WATER HEATER

BACKGROUND OF THE INVENTION

The invention relates to combined-function appliances which satisfy residential food refrigeration and water heating requirements. The combined refrigerator-water heaters may include controls for limiting operation during times of peak electrical use.

All modern residences include separate food refrigeration and water heating appliances. Electrical energy used by the refrigerator's compressor is added as heat to surrounding space. In summer, this heat can reduce comfort and increase air conditioning costs. Winter refrigerator heat output reduces heating system operation but typically substitutes low efficiency electric resistance heat for higher efficiency gas furnace or electric heat pump output. Current nationwide U.S. data indicate that the typical new "top freezer, automatic defrost" residential refrigerator uses approximately 1000 kWh per year and discharges approximately 8 million Btu's per year into its surroundings, about 60% of the typical annual water heating requirement.

Where available, combustion fuels (natural gas, propane, and heating oil) are preferred energy sources for domestic water heating because of their lower energy costs compared to resistance electric heating. Electric heat pump water heaters, which have favorable energy efficiencies and operating costs, have not been popular due to high initial costs and poor reliability. Typical combustion water heaters, while preferred over resistance electric heaters, have center flues which contribute to high "standby" losses (energy losses which occur while the unit is idle).

For typical residential systems, only about half the heat energy consumed by the heater is delivered in hot water; the remainder becomes combustion, standby, and distribution piping losses. In homes with the water heater located remote from the kitchen in a garage or outdoor closet (for access to combustion air), up to half the typical distribution piping heat losses are attributable to the kitchen sink, which experiences many short hot water draws. Kitchen location of a non-combustion water heater can substantially reduce water heating energy consumption.

In locations with low to moderate cooling loads, the refrigerator is typically the largest residential electrical energy user. Refrigerator energy use increases with room temperature and degree of use, such that refrigerator electrical energy use is typically highest during warm summer afternoons when many electric utilities experience peak power demands. Advanced controls and thermal storage capabilities to reduce on-peak refrigerator operation would benefit electric utilities by reducing new power generation requirements.

The only routine duty required to maintain efficient operation of the conventional refrigerator is periodic cleaning of the air-cooled condenser coil, which may become clogged with dust. Discharging the refrigeration cycle heat of condensation to a water storage tank would eliminate the only user maintenance task now required to maintain operating efficiency for standard home refrigerators.

A combined refrigerator-water heater with "off-peak" controls (i.e., operationally controlled to operate during periods of relatively low electrical energy demand, such as night time hours) would benefit homeowners, builders, electric utilities, and society as a whole. Homeowners would experience substantially lower energy costs and increased safety via elimination of a major gasfired appliance; builders would benefit from elimination of a major component which occupies floor space and requires installation management; electric utilities would benefit from increased revenues and reduced on-peak loads (i.e., loads during periods of relatively high electrical energy demand such as daytime hours); and society would benefit from more efficient energy utilization and reduced global warming.

The prior art discloses many "combined appliance" concepts which combine water heating with space heating or cooling functions. For example, U.S. Pat. Nos. 4,448,037, 4,514,990, 4,299,098, and 4,098,092 each disclose systems which provide space conditioning and water heating from a single appliance. U.S. Pat. No. 3,935,899 discloses a single heat pump connected to a plurality of hot and cold appliances located throughout a household, but without description of specific refrigeration or water heating technologies, and without considering combination of the two in a single appliance. U.S. Pat. Nos. 3,888,303 and 4,188,794 disclose multiple kitchen appliances linked by a circulating thermal exchange fluid, again without specifically disclosing a combined refrigerator water heater appliance. U.S. Pat. No. 4,821,530 discloses a refrigerator with built-in air conditioner, using two compressors and a water-cooled condenser but no use or storage of the heated water.

The prior art references do not describe a "single package," single compressor appliance which directly transfers heat to water at the condenser, capable of satisfying full refrigeration and water heating demands, with controls to limit on-peak electrical energy use; nor do they describe other more advanced combined refrigerator-water heater concepts which provide space cooling performance when refrigerator cooling loads are satisfied, and increased efficiency using multiple refrigeration systems.

SUMMARY OF THE INVENTION

It is an object of the invention to provide a single all-electric residential appliance satisfying food refrigeration and water heating requirements.

It is a further object of the present invention to provide a combined refrigerator-water heating appliance which extracts heat from indoor air to heat water when food refrigeration loads are satisfied.

It is a further object of the present invention to provide a combined refrigerator-water heater with controls and thermal storage capabilities for biasing compressor operation toward hours of off-peak electrical use.

It is a further object of the present invention to provide a combined refrigerator-water heater with dual refrigeration systems for improved efficiency and control.

These and other objects and advantages are obtained by the combined refrigerator-water heater systems in accordance with various preferred embodiments of the present invention. Each system includes:

a refrigerator compartment having insulated freezer and fresh food storage boxes;

an insulated water storage container;

at least one refrigeration circuit including a compressor/evaporator located to extract heat alternately from the refrigerator component and room air, and a condenser located to discharge heat to the water storage container;

means for supplying cold water to and removing heated water from the water storage container; and control means to bias operation toward hours of off-peak electrical use.

BRIEF DESCRIPTION OF THE DRAWINGS

The invention will be described in detail with reference to the following drawings in which like elements bear like reference numerals and wherein.

DETAILED DESCRIPTION OF THE PREFERRED EMBODIMENTS

Figure 1:
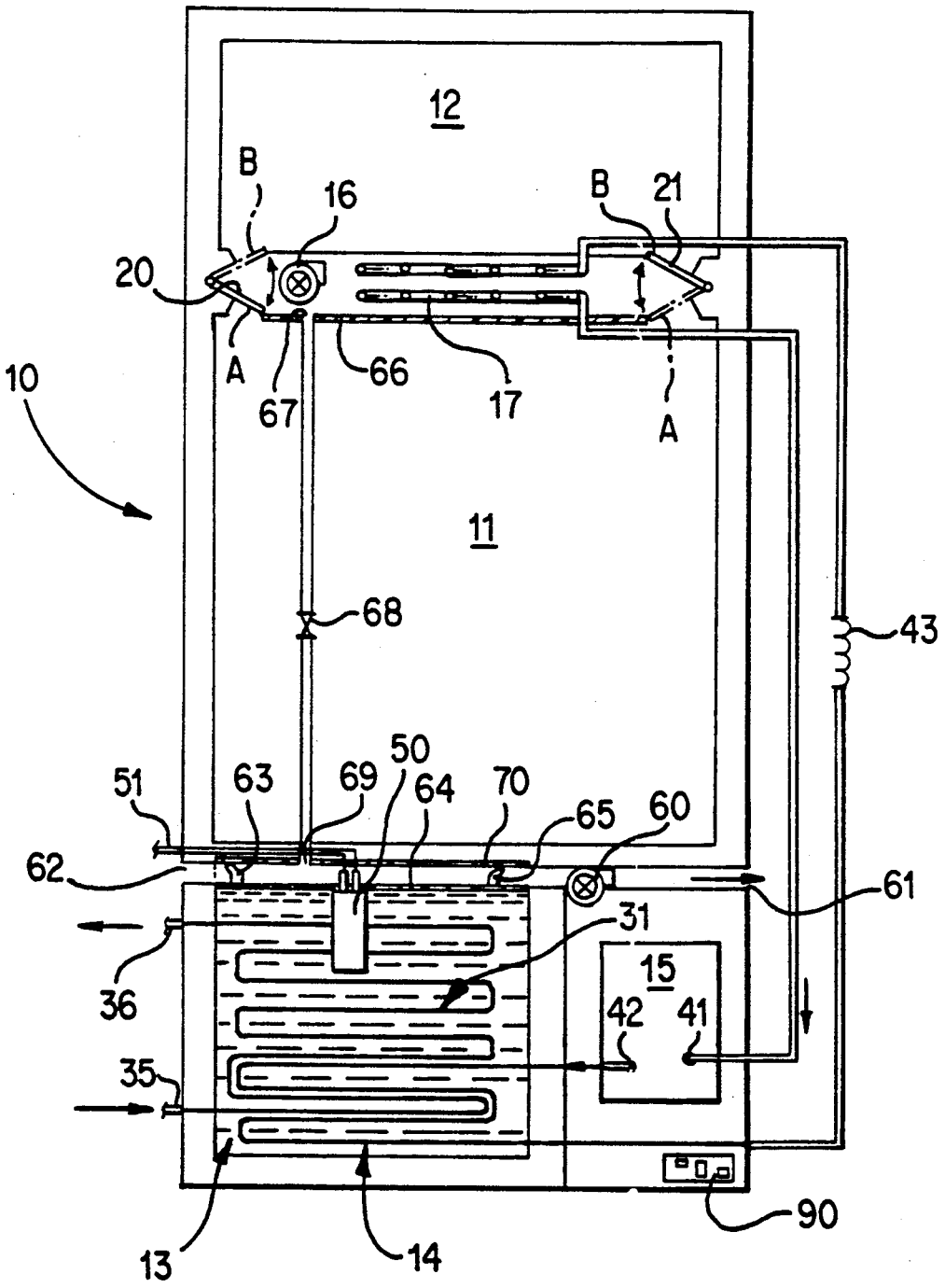
FIG. 1 is a cross-sectional schematic illustration of the preferred embodiment of the combined refrigerator-water heater in accordance with the claimed invention.

The preferred embodiment shown in FIG. 1 includes appliance housing or refrigerator compartment 10 supporting insulated fresh food box 11 below freezer box 12. The insulated water storage compartment or tank 13 is located beneath fresh food box 11. As in conventional refrigerators, a single refrigeration circuit is provided including compressor 15, condenser 14 mostly immersed in hot water storage tank 13, and evaporator 17 (having a blower 16) located between fresh food box 11 and freezer box 12. Water storage tank 13 contains hot water heat exchanger 31 and electric heating element 50 in addition to condenser 14. Cold water enters tank 13 through pipe 35, is heated in the tank, and leaves through pipe 36.

Controller 90 switches operating components on and off based on programmed logic. As will become more apparent from the description herein, the controller 90 receives various input signals, including input signals from temperature sensors located throughout the apparatus in the fresh food box 11, freezer box 12 and water storage compartment 13. The controller 90 generates output signals to selectively activate the operating components, such as the compressor 15, evaporator 16 and associated dampers for airflow to the food box 11 and/or freezer box 12) when the temperature in the food box 11 or freezer box 12 exceeds a desired level, or when the temperature in the tank 13 falls below a desired level. Operation is ceased when the desired temperature level is reached. Further, the controller can selectively activate the electrical heating element 50 to assist in heating the water in the tank when refrigerator heat output is insufficient. The controller also is programmed to determine off peak and on peak periods of electrical use based on a time of day signal. For example, the controller can determine that it is an on-peak period when the time of day signal is, for example 4 PM, and in an off peak period when the time of day signal is for example, 4 AM. The controller 90 controls operation of the apparatus as follows:

Compressor 15 and evaporator blower 16 are activated to cool either freezer box 13 or fresh food box 1 when their temperatures fall below desired levels. When operating, the compressor 15 discharges hot refrigerant gas through discharge port 42. The hot gas travels into condenser tubing 14 immersed in water tank 13, condensing as it is cooled while transferring heat to water surrounding the heat exchange tubing. After leaving condenser 13, the condensed liquid refrigerant travels to capillary tube 43, which restricts flow and imposes a substantial pressure drop. In the low pressure environment downstream from capillary tube 43, the liquid refrigerant cools substantially and enters evaporator 17, where it is heated and vaporized while chilling air is moved through evaporator 17 by evaporator blower 16. Low pressure refrigerant gas leaving evaporator 17 returns to compressor 15 through inlet 41.

In the basic embodiment of FIG. 1, all heat discharged from the refrigeration circuit is delivered to water tank 13. Since water heating demands may exceed heat availability from refrigeration, resistance heat element 50 supplied through electric cable 51 can be activated to add additional heat to the top portion of the water tank to satisfy water heating loads in excess of refrigerator heat output. Condenser tubing 14 is located near the bottom of tank 13 to keep condensing temperature low, maximizing refrigeration cycle efficiency. Controller 90 may be programmed to minimize on-peak energy use by operating resistance heat element 50 prior to a specified on-peak electrical use period to elevate water temperature, thus minimizing the need to operate element 50 during the on-peak period.

Evaporator 17 may be used to cool either freezer 12 or fresh food box depending on the positions of interlocked motorized dampers 20 and 21. With dampers set in positions A and B, evaporator airflow cools the freezer and fresh food box, respectively. Frost which accumulates on the evaporator coil may be melted by a defrost system (not shown), collected in pan 66 beneath evaporator coil 17, and drained through opening 67, one way drain tube valve 68, and opening 69 into lower drain pan 64 which is also the water containment lid of storage tank 13. Pan 64 is below the upper storage tank insulation, and remains warm. Defrost water draining into pan 64 is evaporated and removed by room air entering opening 62, passing through gravity damper 63, drawn across pan 64 and through gravity damper 65 by blower 60, and exiting the appliance through opening 61.

Small blower 60, normally activated by the controller 90 in response to a moisture/temperature sensor in pan 64, may also be activated when water surrounding condenser 14 in tank 13 exceeds an upper limit value (for example, a predetermined value of 135° F.). Water surrounding the condenser can overheat when the refrigerator operates without hot water draws (as can occur when occupants are away from home for several days or more) thus inhibiting reliable compressor operation. Operation of blower 60 and movement of room air in contact with pan 64 cools water in tank 13 to limit water temperature during periods without hot water use.

Sizes of all components in the combined refrigerator-water heater are comparable to those in conventional refrigerators. Hot water storage tank 13 should contain 50 to 60 gallons for typical residential applications. While most residential water heaters store 30 to 40 gallons, it is advantageous for the combined refrigerator-water heater to provide equivalent energy storage with more water at a lower temperature, since lower condensing temperatures contribute to higher refrigeration efficiencies. The larger water storage volume also increases heat storage potential when resistance heat element 50 is used to raise water temperature prior to the on-peak period.

Calculations show that for a typical refrigerator cooling load of 3.34 million Btu's/yr ("M") with a typical new refrigerator, typical water heating loads of 11.05 M including distribution piping heat losses with a typical new gas water heater, rated efficiencies of 82% (steady state) for the gas furnace and SEER=9.0 for central air conditioning, the combined appliance of FIG. 1 would use 19% more electricity for resistance heating than for compressor operation, would increase consumption overall by 1342 kWh annually and reduce gas consumption by 213 therms, considering space conditioning impacts. For a standard "source energy" conversion rate of 10,239 Btu/kWh, the simple combined refrigerator-water heater of FIG. 1 would reduce annual source energy consumption for the example by 23% and 7.6 M. Source energy savings will be higher for lower average water heating loads, and lower for higher average water heating loads.

Figure 2:
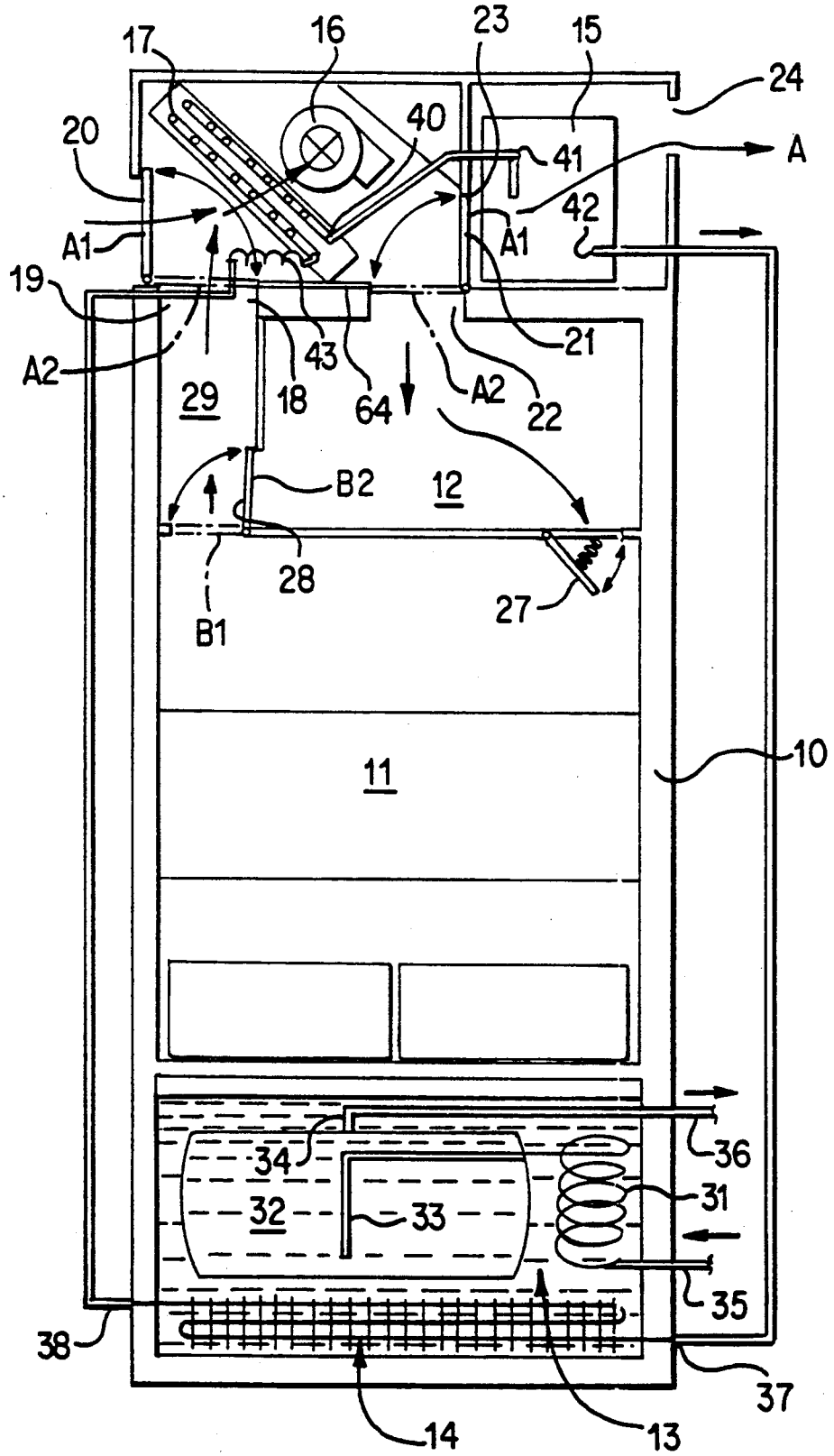
FIG. 2 is a cross-sectional schematic illustration of another preferred embodiment of the combined refrigerator-water heater providing heat extraction from room air.

FIG. 2 shows another preferred embodiment of the combined refrigerator-water heater which substitutes a second refrigeration cycle water heating mode for the resistance heater 50 of the first embodiment. The embodiment of FIG. 2 also incorporates an improved hot water storage tank design to maximize average hot water outlet temperature, and an alternate evaporator airflow arrangement facilitating evaporator placement above the food storage boxes.

In the FIG. 2 embodiment, freezer box 12 is located directly above fresh food box 11, With compressor 15 and evaporator 17 placed above freezer box 12. This configuration places the food storage compartments for easiest access, with water storage and mechanical components filling space less conveniently accessible in the appliance.

Refrigerant flow is driven by compressor 15, which discharges hot refrigerant gas through discharge port 42. Hot gas travels through condenser inlet 37 into condenser tubing 14 immersed in water tank 13, condensing as it is cooled while transferring heat to water surrounding the heat exchange tubing. After leaving condenser 14 through exit 38, the condensed refrigerant travels to capillary tube 43, which restricts flow and imposes a substantial pressure drop. In the low pressure environment downstream from capillary tube 43, the liquid refrigerant cools substantially and enters evaporator 17, where it is heated and vaporized while chilling air moved through evaporator 17 by evaporator blower 16. Low pressure refrigerant gas leaving evaporator 17 returns to compressor 15 through inlet 41.

Interlocked evaporator dampers 20 and 21 allow cooling of the freezer (damper position A1) or room air (position A2). Positions Al of dampers 20 and 21 block openings 19 and 23 between room air and the evaporator, allowing air movement caused by evaporator blower 16 from refrigerator duct 29 through opening 18 and evaporator coil 17, then back to freezer box 12 through opening 22. Positions A2 block openings 18 and 22, allowing room air movement through opening 19 into the evaporator coil and out through opening 23, past compressor 15, and back to room air via opening 24. For normal refrigerator operation, dampers 20 and 21 are in position Al as illustrated in FIG. 2. When refrigerator boxes 11 and 12 are sufficiently cold and more hot water is needed, dampers 20 and 21 are relocated to positions A2, and the unit acts as an indoor heat pump water heater which cools room air while heating domestic water.

In the FIG. 2 embodiment, freezer or fresh food box cooling is selected based on the position of damper 28. With damper 28 in position B2 as illustrated in FIG. 2, air from the fresh food box enters duct 29 enroute through the evaporator, and pressure caused by the evaporator blower causes spring loaded damper 27 to open, cooling fresh food box 11. With damper 28 in position B1, freezer air enters duct 29, flows through evaporator coil 17, and returns to freezer box 12. Damper 27 remains closed because freezer box 12 is open to evaporator inlet duct 29. Thus, damper 28 position B1 chills the freezer, and position B2 chills the fresh food box.

Using ambient air as an auxiliary water heating heat source in the FIG. 2 embodiment provides a significant efficiency improvement compared to using electric resistance auxiliary heat as in the basic embodiment of FIG. 1. The performance improvement results from reducing electrical consumption to satisfy auxiliary water heating loads while increasing the quantity of "free" space cooling provided by the unit. The increased cooling output reduces cooling loads and increases heating loads, which are then satisfied by an efficient heating system rather than the refrigerator acting as a relatively inefficient resistance heater. Compared to the example case previously discussed for the FIG. 1 embodiment, the FIG. 2 embodiment would reduce annual electrical energy consumption by 900 kWh annually while increasing gas consumption by 10 therms, generating net annual source energy use reductions of 15.8 M and 48% compared to the standard refrigerator and gas water heater. These source energy savings are remarkable considering the 3:1 source energy penalty applied to electrical energy use.

The FIG. 2 refrigerator-water heater embodiment is enhanced with a more complex heat exchange system in hot water storage tank 13. Since electric resistance auxiliary heat is not provided, tank water temperature is limited by refrigerant condensing temperature. With typical refrigerator compressors and refrigerants it may be difficult to heat tank water beyond 140° F. Since codes require "double wall" separation between refrigerant and domestic water, it is advantageous to provide heat exchange features which minimize the average temperature difference between tank water and outlet water. Another significant consideration affecting heat exchange design is the relatively slow tank heating rate of the refrigeration system compared to conventional gas-fired water heaters. The modest refrigerator-water heater heating output can be partially offset by increased water storage.

Figure 3:
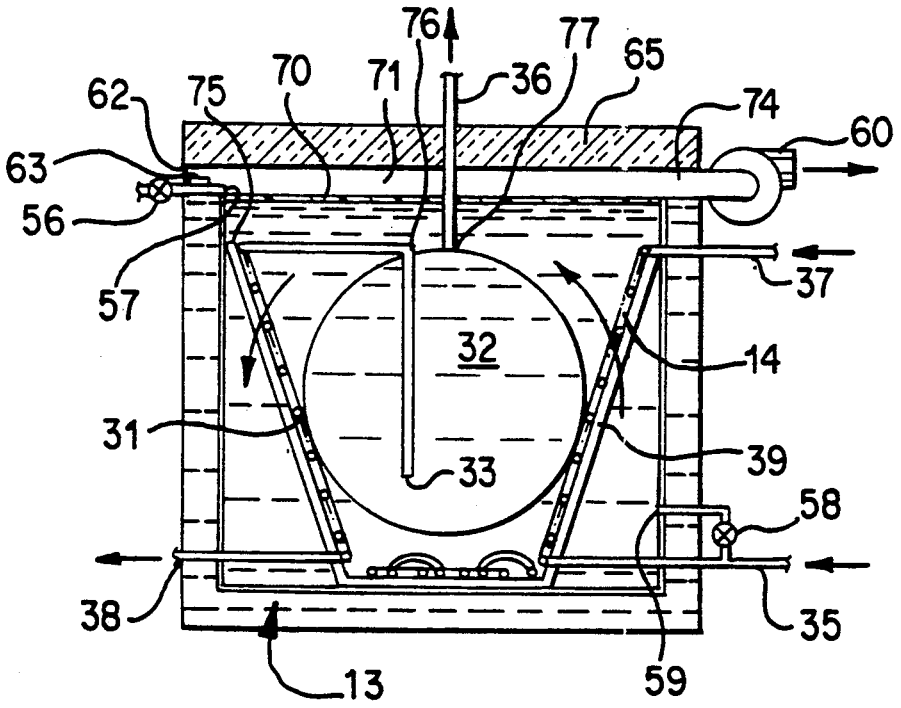
FIG. 3 is a cross-sectional schematic illustration of a preferred insulated storage water container and immersed heat exchangers for the embodiment of FIG. 2.

The hot water heat exchange arrangement shown schematically in FIG. 2, and further detailed in FIG. 3, improves hot water delivery temperatures by adding an immersed pressurized tank to the "single pass" water heating heat exchanger of the FIG. 1 embodiment. With condenser tubing 14 immersed near the bottom of tank 13, an immersed tank 32 is placed above condenser 14. Pressurized cold water enters tank 13 through inlet 35, passes through tubular heat exchanger section 31, and enters pressurized immersed tank 32 through "dip tube" 33. Water entering tank 32 has been preheated by passage through heat exchanger 31, reducing its tendency to cool hot water stored in tank 32. Nearly half the total stored hot water can be located in tank 32 (with the remainder unpressurized in outer tank 13), and will gradually reach equilibrium with outer tank water in the absence of compressor operation or hot water draws. Thus, the full volume of inner tank 32 can be available at relatively constant temperature to satisfy extended hot water draws. Without the inner tank, a typical tubular heat exchanger 31 could only deliver hot water at a temperature five to ten degrees cooler than water in tank 13.

FIG. 3 provides a cross-sectional view of a preferred immersed tank design. Rack 39, which may be constructed of rigid ½" nominal copper tubes, supports immersed tank 32 and serpentine tubular heat exchangers 14 (condenser) and 31 (hot water) within insulated atmospheric tank 13. Tank 13 is preferably of rectangular design whose external plan dimensions are equal to those of the refrigerator sections above, with depth selected to provide the desired water storage volume. For typical refrigerator 36" wide by 26" plan dimensions, 21" storage tank height is required for 60 gallon containment if all six tank walls are 2" thick.

The inner shell of tank 13 is preferably constructed of a molded rigid plastic material capable of withstanding continuous 140° F. temperature, with urethane insulation foamed in place between the inner shell and a similar outer shell. Water surrounding inner tank 32 and heat exchangers 14 and 31 immersed in tank 13 serves as a heat exchange/heat storage medium and does not mix with domestic water flowing through the heat exchange system. Tank 13 may be filled through valve 58 with water entering through port 59. When tank 13 is full, water overflows through port 57 and open valve 56; valves 58 and 56 are then closed.

Air space 71 is provided between rigid plastic top panel 70 and insulated lid 65 of tank 13; the lid also serves as floor of the fresh food box in the "top freezer" refrigerator-water heater configuration. Air space 71 facilitates tank cooling when refrigerator heat output exceeds water heating demand, as may occur during nonoccupancy periods. When tank 13 has reached its upper temperature limit, blower 60 is activated to create negative pressure in air space 71, opening spring-loaded damper 63 to pull room air through opening 62 and across upper tank surface 70. The air is heated by contact with surface 70, cooling the tank, before passing through blower 60 and returning to room air. Blower 60 may be deactivated when the temperature of water in tank has been reduced by approximately two degrees F.

Serpentine condenser heat exchanger 14 is supplied with hot refrigerant gas through inlet 37, which then flows through a continuous copper tubing array (preferably of ¼" diameter) configured as straight horizontal sections with return bends to form a serpentine pattern. Condenser 14 proceeds downward at a slightly inward angle from entry 37 to the bottom of rack 39, and then continues across the bottom of rack 39 to exit 38 from which refrigerant leaves the tank to flow toward the capillary tube and evaporator. Alternatively, refrigerant leaving the tank condenser section may flow through an external condenser section placed under a pan to evaporate collected defrost water. Condenser 14 may be secured to rack 39 either by solder or by wiring, or rack 39 may be of plastic molded with recesses to hold both serpentine tubing arrays.

Water heating heat exchanger 31 is of similar pattern to condenser heat exchanger 14, but is constructed of larger tubing (typically ¾" nominal copper) to accommodate water flow rates up to 5 gallons per minute. Cold water enters exchanger 31 through entry 35, flows in serpentine pattern across the bottom of rack 39 where tubes alternate with condenser heat exchanger 14, and then up the sloping side of rack 39 opposite the condenser side previously described. Preheated water leaves the serpentine section at 75, enters a "dip tube" in inner tank 32 at entry 76, and proceeds downward to leave the dip tube and mix with hotter inner tank water at exit 33. Hot water leaves the inner tank at exit 77, and is piped through the outer tank wall at exit 36, from which it proceeds to hot water fixtures.

FIG. 3 shows an end view of inner tank 32, which is of horizontal-axis cylindrical design. In the configuration shown, inner tank 32 is preferably constructed of stainless steel in 15" diameter and 30" length, to hold approximately 23 gallons. Tank 32 rests against portions of exchangers 14 and 31, and is supported by rack 39.

The tank embodiment of FIG. 3 provides excellent hot water temperature outlet profiles because between draws inner tank 32 warms to the same temperature as surrounding water heated by condenser 14. The heat exchanger configuration promotes excellent heat transfer for several reasons. Cool water entering the bottom of exchanger 31 is close to the lower portion of condenser 14, lowering condensing temperature and increasing refrigeration cycle efficiency. Cooler water proceeding through exchanger 31 cools the surrounding water, increasing density and causing downward convection currents. On the other side, hot refrigerant in condenser 14 heats surrounding water, causing upward convection currents. The configuration causes a counter-clockwise convective flow pattern around (and inside) inner tank 32, increasing the rate of heat transfer.

Figure 4:
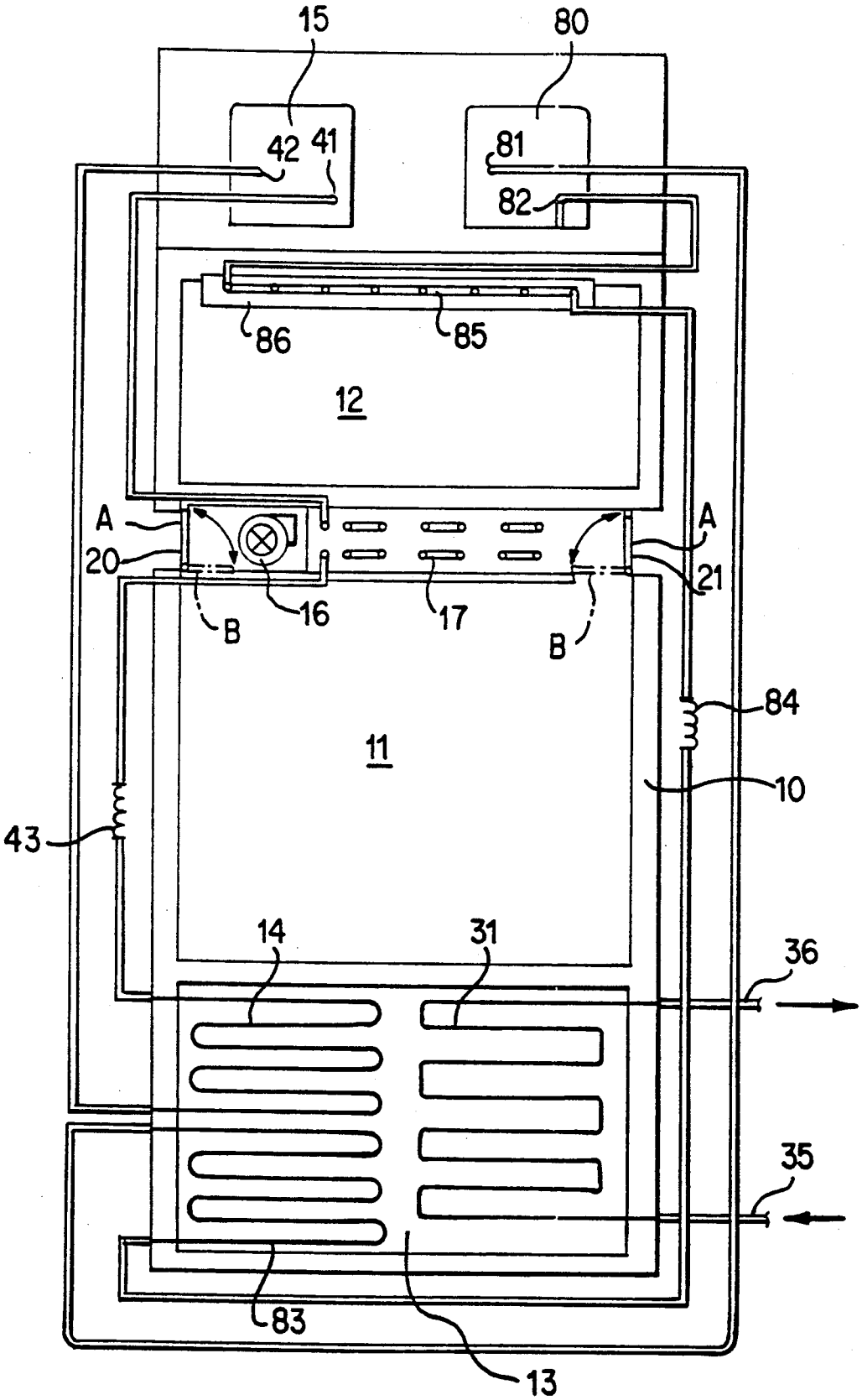
FIG. 4 is a cross-sectional schematic illustration of a further preferred embodiment of the combined refrigerator-water heater using dual refrigeration circuits and incorporating phase-change freezer thermal storage materials to maximize shifting of compressor operation from on-peak to off-peak hours.

FIG. 4 shows another preferred embodiment of the combined refrigerator-water heater featuring dual compressors and refrigeration circuits. The dual compressor design has advantages of redundancy, higher efficiency, and increased water heating capacity. The FIG. 4 embodiment is also enhanced with phase change media in the freezer to facilitate longer freezer compressor operation during water heating recovery cycles after hot water draws.

Conventional refrigerators and the two previously-described embodiments of the combined refrigerator require compressor operation through a wide temperature differential, from evaporating temperatures as low as −10 F to condensing temperatures as high as 120 F (conventional) and 140 F (water heating). Refrigeration cycle efficiencies would increase if the average operating temperature differential could be decreased. Also, in single compressor designs, all food cooling capability is lost if the compressor or any element in the pressurized refrigeration circuit should fail. With separate refrigeration circuits for freezer and fresh food box cooling, one could keep operating even if the other circuit failed.

For the combined refrigerator-water heater, dual refrigerant circuits provide a particular advantage because of the wider temperature range caused by high condensing temperatures required for water heating. In the preferred dual refrigeration circuit embodiment of FIG. 4, the low temperature circuit evaporates from the freezer and condenses to the lower portion of tank 13; the high temperature circuit evaporates from either the fresh food box or room air, and condenses to the top portion of tank 13. In tank 13, a simplified hot water heat exchanger 31 is shown without the immersed tank of FIGS. 2 and 3. Cold water enters exchanger 31 at bottom pipe 35, flows upward through a serpentine coil, and exits at top pipe 36. Cool inlet water lowers lower tank temperature to improve compressor operating efficiency, and water leaves the tank at the top where the high temperature refrigeration circuit maintains hotter tank water.

With reference to FIG. 4, high temperature compressor 15 discharges hot refrigerant gas through port 42, which flows through condenser tubing 14 immersed in the upper portion of hot water tank 13. From the condenser, high pressure liquid refrigerant flows to capillary tube 43, where pressure is reduced before entering evaporator coil 17 which cools air forced through the evaporator by evaporator blower 16. Low pressure refrigerant gas returns to the compressor through port 41 after leaving evaporator 17. Evaporator dampers 20 and 21 are located in position A for normal operation to cool the fresh food box, and in position B for heat extraction from room air as needed to satisfy water heating loads in excess of heat available from normal refrigeration operation.

Since evaporator 17 is never exposed to freezer air, its evaporating temperature need never fall below 32 F, compared to (−10 F) for typical refrigerator operation. As a result, compressor 15 will operate with higher average efficiency than a conventional refrigerator despite its slightly higher average condensing temperature. Also, defrosting should not be required for high temperature evaporator 17 because the coil surface will remain above freezing.

Low temperature compressor 80 discharges hot refrigerant gas through port 81; the hot gas flows through condenser 83 located in the lower portion of tank 13. Condensed high pressure refrigerant then flows through capillary tube 84 enroute to freezer evaporator 85 encased in phase change material 86. The low pressure refrigerant evaporates and cools both the phase change material 86 and freezer box 12 before returning as a low pressure gas to compressor 80 through port 82.

Phase change material 86 changes from solid to liquid state at approximately 0° F. and must be contained within flexible containers to withstand repeated freeze-thaw cycles. Many packaged freezer-type phase change systems are commercially available. Freezer phase change material 86 provides two benefits to the combined refrigerator-water heater system. When substantial water heating loads occur, phase change storage allows operation of compressor 80 to continue raising the temperature of tank 13 when freezer loads are satisfied; evaporator 85 freezes phase change material rather than further lowering freezer temperature. The frozen phase change material thaws slowly and reduces the need for additional operation of compressor 80 before the next hot water draw.

The second phase change benefit is facilitation of off-peak compressor operation. Compressor 15 can operate pre-peak to extract heat from indoor air with dampers 20 and 21 in position B, raising the upper portion of tank 13 above normal temperature to reduce the likelihood of subsequent on-peak compressor operation, but without phase change material 86 in freezer 12, the lower portion of tank 13 could not be boosted pre-peak because the freezer would become too cold for continued compressor operation.

Electric resistance auxiliary water heating input is an optional feature applied to combined refrigerator-water heater embodiments which either omit an indoor air heat source and/or provide inadequate water heating recovery via compressor operation. Resistance auxiliary heat lowers system source energy efficiency but offers a major opportunity for electric utility load control. Resistance heat may be used to heat stored water to an elevated temperature prior to the on-peak period, virtually eliminating on-peak electrical use for water heating. A control interlock preventing simultaneous on-peak compressor and auxiliary resistance heat operation would offer significant value to electric utilities.

The invention has been described with reference to three embodiments, which are intended to be illustrative and not limiting. Various changes may be made without departing from the spirit and scope of the invention as defined in the following claims.

WHAT IS CLAIMED IS:

1. A combined refrigerator-water heating system comprising in a single unit at least one insulated food storage compartment; an insulated water storage compartment; a refrigeration system including a compressor, an evaporator heat exchanger for cooling said food storage compartment, a condenser for heating said water storage compartment, a flow restriction/expansion device, and piping connecting said compressor, condenser, expansion device, and evaporator in a series flow loop; a resistance electric heating element for heating said water storage compartment; and control means for determining periods of on and off peak electric use in response to a time of day signal, for activating said compressor in response to cooling demand from said food storage compartment, and for activating said electric heating element in response to at least one of heating demand from said water storage compartment and a time-of-day signal to bias resistance electric water heating operation toward times of off-peak electric use.

2. The combined refrigerator-water heating system according to claim 1, wherein said condenser is a first condenser, and further comprising a second condenser heat exchanger located in downstream series flow relationship with said first condenser, said second condenser being in heat exchange relationship with ambient air to facilitate compressor operation for cooling of said food storage compartment when a temperature of said water storage compartment exceeds a predetermined temperature for reliable compressor operation.

3. A combined refrigerator-water heating system comprising at least one insulated food storage compartment; an insulated water storage compartment; a refrigeration system including a compressor, an evaporator heat exchanger for cooling said food storage compartment, a condenser for heating said water storage compartment including a controllable heat exchanger for discharging heat from said water storage compartment to ambient air when a temperature of said water storage compartment exceeds a predetermined temperature for reliable compressor operation, a flow restriction/expansion device, and piping connecting said compressor, condenser, expansion device, and evaporator in a series flow loop; a resistance electric heating element for heating said water storage compartment; and control means for determining periods of on and off peak electric use in response to a time of day signal, for activating said compressor in response to cooling demand from said food storage compartment, and for activating said electric heating element in response to at least one of heating demand from said water storage compartment and a time-of-day signal to bias resistance electric water heating operation toward times of off-peak electric use.

4. A combined refrigerator-water heating comprising at least one insulated food storage compartment; an insulated water storage compartment; a refrigeration system including a compressor, an evaporator heat exchanger for cooling said food storage compartment, a condenser for heating said water storage compartment, a flow restriction/expansion device, and piping connecting said compressor, condenser, expansion device, and evaporator in a series flow loop; a resistance electric heating element for heating said water storage compartment; and control means for determining periods of on and off peak electric use in response to a time of day signal, for activating said compressor in response to cooling demand from said food storage compartment, and for activating said electric heating element in response to at least one of heating demand from said water storage compartment and a time-of-day signal to bias resistance electric water heating operation toward times of off-peak electric use, wherein said control means controls activation of said resistance electric heating element to preclude simultaneous operation of said compressor and said resistance heating element during programmable periods of on peak electrical use.

5. A combined refrigerator-water heating system comprising at least one insulated food storage compartment; an insulated water storage compartment; a refrigeration system including a compressor, an evaporator heat exchanger for cooling said food storage compartment, a condenser for heating said water storage compartment, a flow restriction/expansion device, and piping connecting said compressor, condenser, expansion device, and evaporator in a series flow loop; a resistance electric heating element for heating said water storage compartment; and control means for determining periods of on and off peak electric use in response to a time of day signal, for activating said compressor in response to cooling demand from said food storage compartment, and for activating said electric heating element in response to at least one of heating demand from said water storage compartment and a time-of-day signal to bias resistance electric water heating operation toward times of off-peak electric use; wherein said water storage compartment comprises an outer insulated storage tank containing water at atmospheric pressure, an inner pressurized water tank immersed within said outer storage tank, a pressurized linear water tube conveying supply water through a surface of said outer tank, passing through and in extended heat exchange relationship with said water at atmospheric pressure, and into said inner tank, a pressurized water exit tube from said inner tank passing through a surface of said outer tank, a condenser heat exchange tube passing through and in extended heat exchange relationship with said water at atmospheric pressure, and said resistance electric heating element.

6. A water storage compartment according to claim 5, wherein said water tube enters said outer tank at a lower portion of said outer tank and proceeds progressively upward within said outer tank, entering said inner tank adjacent an upper portion of both said inner and outer tanks.

7. A water storage compartment according to claim 5, wherein said condenser heat exchange tube enters said outer tank adjacent an upper portion of the outer tank and proceeds progressively downward within said outer tank, before exiting said outer tank.

8. A water storage compartment according to claim 5, wherein said water tube enters said outer tank at a lower portion of said outer tank and proceeds progressively upward within said outer tank, entering said inner tank adjacent an upper portion of both said inner and outer tanks; and said condenser heat exchange tube enters said outer tank adjacent the upper portion and proceeds progressively downward within said outer tank, before exiting said outer tank.

9. A combined refrigerator-water heating system comprising an insulated freezer compartment and a fresh food storage compartment; an insulated water storage compartment; first and second refrigeration systems, each including a compressor, an evaporator heat exchanger, a condenser heat exchanger for heating said water storage compartment, a flow restriction expansion device, and piping connecting said compressor, condenser, expansion device, and evaporator in a series flow loop, wherein said evaporator for said first refrigeration system cools said freezer compartment, and said evaporator for said second refrigeration system cools said fresh food storage compartment; a resistance electric heating element for heating said insulated water compartment; and control means for determining periods of on and off-peak electric use in response to a time of day signal, for activating said compressors in response to cooling demand from said freezer and fresh food compartments, and for activating said electric heating element in response to at least one of heating demand from said water storage compartment and a time-of-day signal to bias resistance electric water heating operation toward times of off-peak electric use.

10. A combined refrigerator-water heating system according to claim 9, wherein said control means controls said resistance electric heating element to preclude simultaneous operation of said compressor and said resistance heating element during programmable periods of on-peak electrical use.

11. A combined refrigerator-water heating system according to claim 9, wherein said condenser heat exchanger for said first refrigeration system heats water in a lower portion of said water storage compartment, and said condenser heat exchanger for said second refrigeration system heats water in an upper portion of said water storage compartment.

12. A combined refrigerator-water heating system according to claim 9, wherein the condensers of the first and second refrigerator systems are first and second condenser heat exchangers, respectively, and wherein the second condenser heat exchanger is in heat exchange relationship with ambient air to facilitate compressor operation for cooling said fresh food storage compartment when a temperature of said water storage compartment exceeds a predetermined temperature for reliable compressor operation.

13. A combined refrigerator-water heating system according to claim 9, wherein said water storage compartment includes controllable heat exchange for discharging heat from said water storage compartment to ambient air when a temperature of said water storage compartment exceeds a predetermined temperature for reliable compressor operation.

14. A combined refrigerator-water heating system according to claim 11, wherein the condensers of the first and second refrigerator systems are first and second condenser heat exchangers, respectively, and wherein the second condenser heat exchanger is in heat exchange relationship with ambient air to facilitate compressor operation for cooling of said fresh food storage compartment when a temperature of said water storage compartment exceeds a predetermined temperature for reliable compressor operation.

15. A combined refrigerator-water heating system according to claim 11, wherein said water storage compartment includes controllable a heat exchanger for discharging heat from said water storage compartment to ambient air when a temperature of said water storage compartment exceeds a predetermined temperature for reliable compressor operation.

16. A combined refrigerator-water heating system comprising at least one insulated food storage compartment; an insulated water storage compartment; a refrigeration system including a compressor, an evaporator heat exchanger for alternately cooling said food storage compartment and ambient air, a condenser for heating said water storage compartment, a flow restriction/expansion device, and piping connecting said compressor, condenser, expansion device, and evaporator in a series flow loop; and control means for determining periods of on and off-peak electric use in response to a time of day signal, and for activating said compressor alternately in response to cooling demand from said food storage compartment with said evaporator cooling said food storage compartment and heating demand from said water storage compartment with said evaporator cooling ambient air.

17. A combined refrigerator-water heating system according to claim 16, wherein said control means activates said compressor with said evaporator cooling ambient air in response to one of heating demand from said water storage compartment and a time-of-day signal to bias refrigeration water heating operation toward times of off-peak electric use.

18. A combined refrigerator-water heating system comprising at least one insulated food storage compartment; an insulated water storage compartment; a refrigeration system including a compressor, an evaporator heat exchanger configured to alternately cool said food storage compartment and ambient air, a condenser configured to heat said water storage compartment, a flow restriction/expansion device, and piping connecting said compressor, condenser, expansion device, and evaporator in a series flow loop; a resistance electric heating element for heating said water storage compartment; and control means for determining periods of on and off-peak electric use in response to a time of day signal, for activating said compressor alternately in response to cooling demand from said food storage compartment with said evaporator cooling said food storage compartment and heating demand from said water storage compartment with said evaporator cooling ambient air, and for activating said electric heating element in response to one of heating demand from said water storage compartment and a time-of-day signal to bias resistance electric water heating operation toward periods of off-peak electric use.

19. A combined refrigerator-water heating system according to claim 18, wherein said control means controls the resistance electric heating element to preclude simultaneous operation of said compressor and said auxiliary resistance heat during programmable period of on-peak electrical use.

20. A combined refrigerator-water heating system according to claim 18, wherein said control means activates said refrigeration system in response to said time-of-day signal to bias compressor operation toward times of off-peak electrical use, and lowers storage compartment temperature to a controlled off-peak setting below that maintained as an on-peak setting during on-peak electrical use periods.

21. A control means according to claim 20, wherein said storage compartment includes thermal storage media which freezes at a temperature between the off-peak and on-peak controlled storage compartment temperature settings.

* * * * *